United States Patent [19]

Götz

[11] 4,065,954

[45] Jan. 3, 1978

[54] RAM-GUIDING FRAME

[75] Inventor: Martin Götz, Sersheim, Germany

[73] Assignee: Erich Grau Stanzwerk fur Elektrobleche, Sersheim, Germany

[21] Appl. No.: 631,064

[22] Filed: Nov. 12, 1975

[30] Foreign Application Priority Data

Nov. 20, 1974 Germany ..... 2454960

[51] Int. Cl.[2] ..... B21J 13/04

[52] U.S. Cl. ..... 72/456; 100/214

[58] Field of Search ..... 72/456, 455, 450; 100/214

[56] References Cited

U.S. PATENT DOCUMENTS

| | | | |
|---|---|---|---|
| 364,142 | 5/1887 | Stiles | 72/450 |
| 1,089,558 | 3/1914 | Hinde | 72/450 |
| 1,268,370 | 6/1918 | Lindgren | 72/450 |
| 1,801,024 | 4/1931 | Schloz | 100/214 |
| 2,017,784 | 10/1935 | Clouse | 72/456 |
| 2,652,770 | 9/1953 | Wilkins | 100/214 |
| 3,111,100 | 11/1963 | Georgeff | 72/455 |
| 3,611,918 | 10/1971 | Marsh | 72/456 |
| 3,858,432 | 1/1975 | Voorhees | 72/456 |

*Primary Examiner*—C.W. Lanham
*Assistant Examiner*—Gene P. Crosby

[57] ABSTRACT

A machine for processing stock by using a ram is disclosed. The machine has a frame structure with a ram-guiding frame therein. The ram-guiding frame is symmetrical in cross-section and has forward and rear members which leave free a first space through which tools are accessible. The members have end side portions which leave free a second space for feeding stock. Vertically adjustable guides for guiding the ram are detachably connected between the ram and the end side portions of the forward and rear members.

7 Claims, 4 Drawing Figures

RAM-GUIDING FRAME

This invention relates to a machine frame for punching machines or presses in which the ram is longitudinally guided and the stock to be punched or embossed is fed in a lateral direction.

In known punching machines and presses, the rams are either guided by means of columns, which also connect the lower platen of the machine to the crosshead. Alternatively, the machine frame is U-shaped in cross-section and provided on both sides with guides for the ram. For reasons of machining technology, at least one side of the main body must remain open in this case. In both cases, a disadvantage resides in that the body of the press lacks cross-bracing in the region in which critical vibrations occur. Besides, the lower end of the guides for the ram must be disposed above the space in which the tools are installed because otherwise the guides would be an obstriction when the tools are to be installed. For this reason there is a considerable distance between the guides for the ram and the guides for the tools and this fact results also in unfavorable stresses.

It is an object of the invention to provide a frame which is adapted to take up vibrations and which has ram guides extending down to a low level. In a machine frame for punching machines or presses, in which the ram is longitudinally guided and the material to be punched or embossed is fed in a lateral direction, this object is accomplished according to the invention in that the ram-guiding frame is symmetrical in cross-section and forms a passage for the insertion of the tools and above said passage has forward and rear frame members having side end portions and also comprises ram guide means, which are detachably mounted on said end side portions above the path for the stock to be worked upon. The ram guide means detachably mounted on the end side portions consist of female guide members, which leave open the space for the installation of the tools and when the tools have been inserted, the lower ends of the female guide members overlap guides carried by the ram even when the latter is in its lowermost position. The ram-guiding means consisting of female and male guides are adjustable from the outside of the machine. The ram-guiding frame is peripherally closed above said spaces and its guide means are approximately centrally disposed with respect to the end side portions of the forward and rear members. This results in a particularly stable machine frame with downwardly extended ram guides so that the frame may be light in weight.

Figure 1:
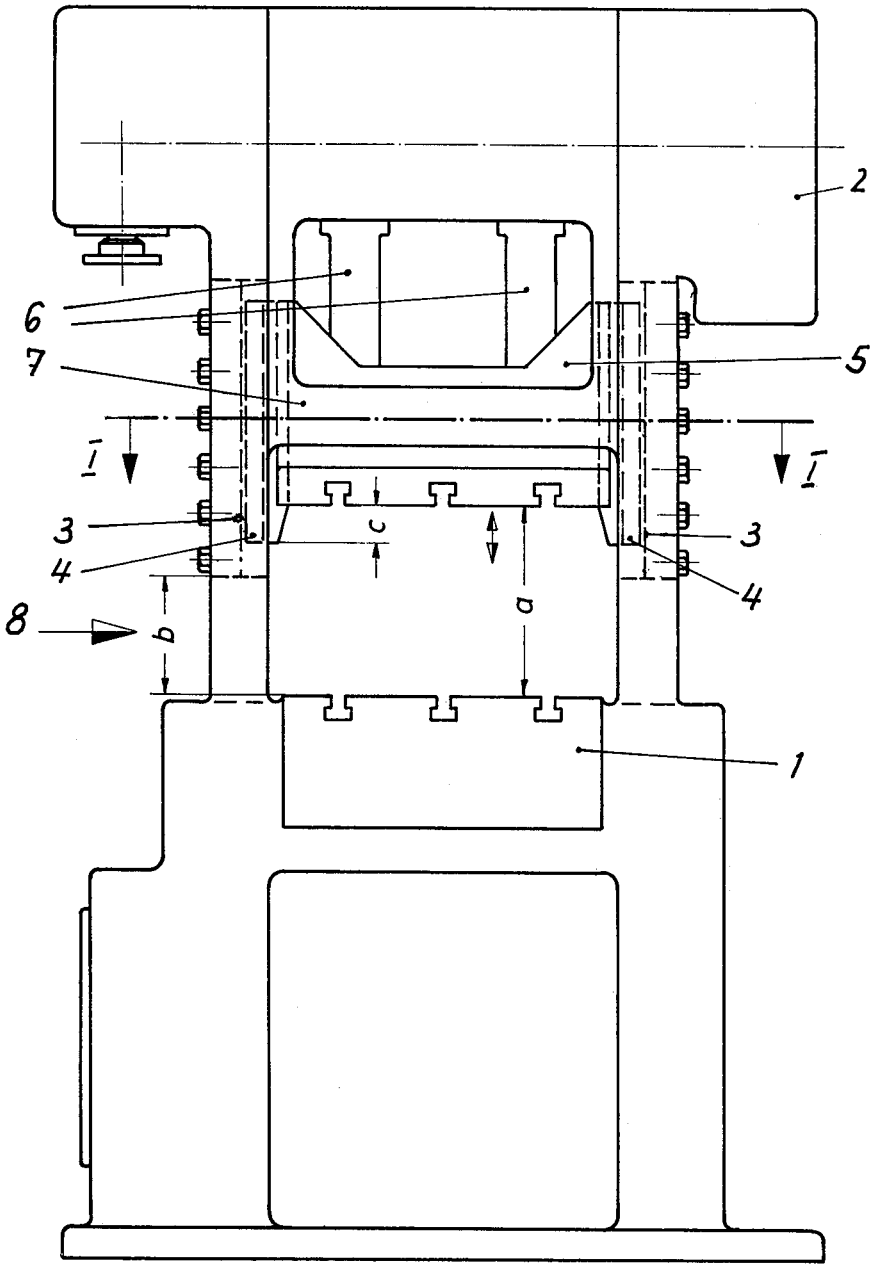
Figure 2:
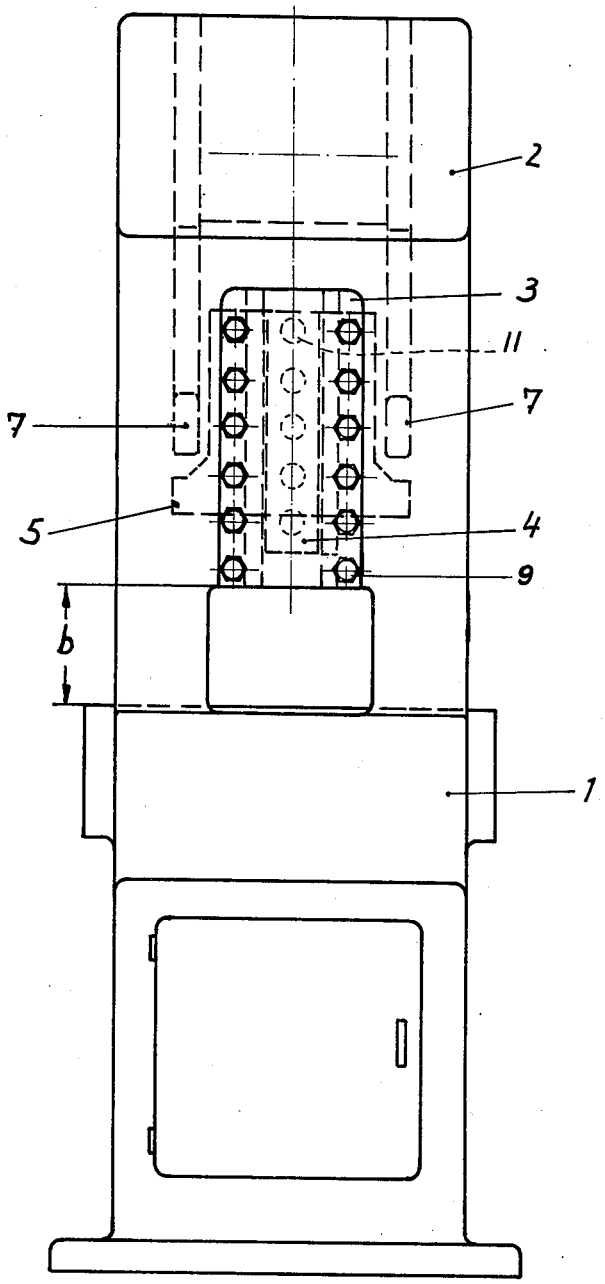
Figure 3:
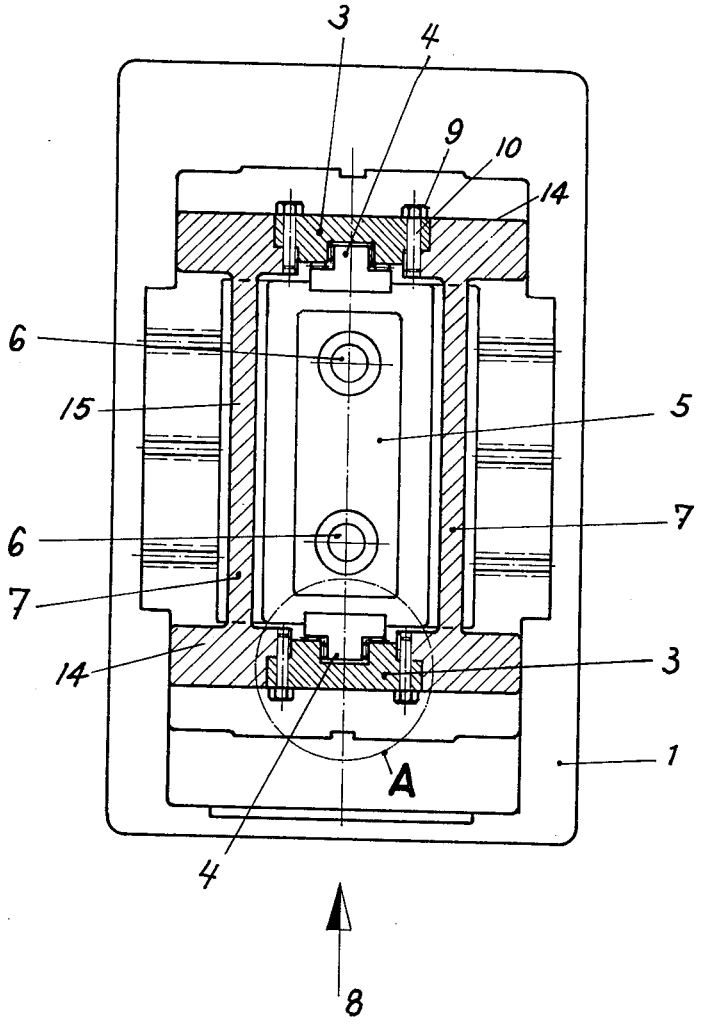
Figure 4:
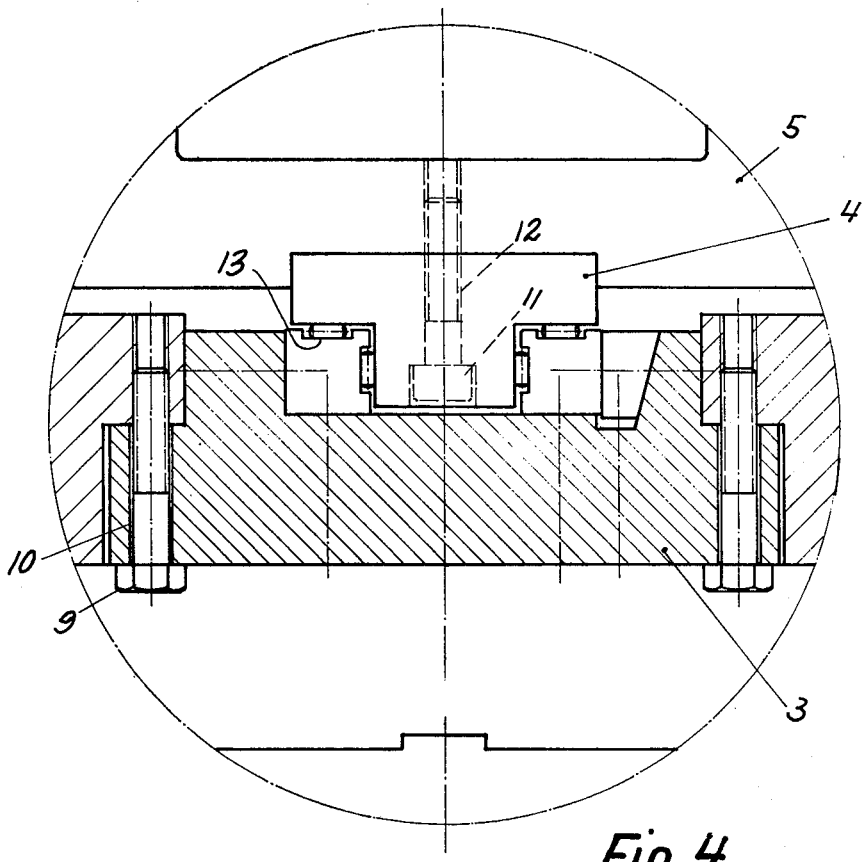

An embodiment of the frame for punching machines or presses according to the invention is shown by way of example on the drawing, in which FIGS. 1 and 2 are, respectively, a forward side elevation and end elevation showing a machine frame according to the invention and FIGS. 3 and 4 are respectively, a transverse sectional view taken on line I-I in FIG. 1 and an enlarged fragmentary view showing part of FIG. 3.

It is apparent from the drawing that the machine frame comprises a base, a lower platen 1, and a crosshead 2, cooperating with a ram guiding frame 15 which closely embraces the ram 5. The ram guiding frame 15 has smaller dimensions than the machine frame and is symmetrically and centrally disposed within the depth of the machine frame being overlapped thereby. In the present embodiment, the ram 5 is suspended by a double connecting-rod 6 from a continuous eccentric shaft. In accordance with the invention, the ram-guiding frame is symmetrical in cross-section and comprises forward and rear members 7 having end side portions 14 carrying female guide members 3, which receive male guide members 4 provided on the ram 5, as is particularly apparent from the sectional view of FIG. 3. On the forward side, a space *a* is left free between the ram 5 and the lower platen 1 to permit of an insertion of the tools, and also a space *b* at one end for receiving material as indicated by an arrow 8. The female guide members 3 provided at both ends of the frame are detachably mounted and leave free the space *a* for receiving the tools throughout the width of said space and extend to a low level so that the lower ends of the male and female guide members overlap by a distance *c* when the tools have been inserted and the ram 5 is in its lowermost position. The ram-guiding means consisting of female guide members 3 are adjustable from the outside of the machine by any conventional means. For example, the female guide members 3 may be detachably secured to the end side portions of the forward and rear members of the ram guiding frame 7, by means of bolts or screws 9 fastened in transverse bores 10 horizontally disposed in guide members 3 and the end side portions of the guiding frame members. The transverse bores 10 are preferably equally spaced on opposite sides of the female guide members 3 forming two vertical rows, on the surface thereof. The male guides 4, as shown in FIG. 4, are detachably affixed to ram 5, by means of screws 11 disposed in transverse bores 12, located in the male guides and the ram.

Additional operative and adjusting means that are old in the art, as shown in FIGS. 3 and 4, are provided by rollers 13 affixed in a spaced relationship to the four faces of each of the male guides 4. By using the rollers 13, both the male guides 4 and female guide members 3, can roll or ride on the corresponding surfaces of each other. According to this embodiment, the male guides 4 and female guide members 3 can be adjusted at any time from outside the machine by unscrewing or detaching bolts or screws 9 and 11, so that guide members 3 and 4 can be reaffixed to the machine in relatively different positions. The guides are to be adjusted in a vertical direction by raising and lowering the guides over the space *b*.

As is apparent from the drawing, the ram-guiding frame, which is peripherally closed above the spaces *a* and *b* and its guiding means are approximately centrally disposed with respect to the axes of the end side portions 14 of the forward and rear members 7. The frame is entirely closed at both ends by the female guide members 3, which are inserted and bolted in such a position that the space *a* for receiving the tools remains freely accessible. Owing to this design, the frame can take up vibrations during the operation of the machine and a relatively light frame may be used even in high-speed machines.

What is claimed is:

1. In a machine for processing stock comprising the combination of a frame construction having a base lower platen and crosshead members, tool holding means adapted to have a first tool detachably fixed thereto, and a ram having a tool holding portion adapted to have a second tool detachably fixed thereto, said ram adapted to move said tool holding portion towards said tool holding means, the improvement which resides in a ram guiding frame being symmetrical in cross-section and closely embracing said ram, said guiding frame having smaller dimensions than the frame construction and being centrally disposed relative thereto, within the depth thereof, said guiding frame comprising forward and rear members which leave free a first space through which said tool-holding means and said tool-holding portion are accessible, said forward and rear members having end side portions which leave free a second space through which said stock to be processed can be fed into position between said first and second tools, and ram guiding means terminating short of said second space, said guiding means detachably connected to said end side portions, to peripherally close said guiding frame above first and second spaces, and form an integral part thereof.

2. The improvement set forth in claim 1 in a machine in which said ram-guiding frame is vertical and said ram-guiding means have a lower end disposed above said second space.

3. The improvement as set forth in claim 1, in which said ram is movable toward said tool holding means to an end position, said ram-guiding means consist of female guide members, said ram carries male guides engaging said female guide members, and the lower ends of said female guide members and male guides overlapping when said ram is in said lowermost position.

4. The improvement set forth in claim 1, in which said ram guiding means consist of female guide members, said ram carries male guide members, and said female and male guide members are adjustable from the outside of the machine.

5. The improvement set forth in claim 1, which is embodied in a punching machine.

6. The improvement set forth in claim 1, which is embodied in a press.

7. The improvement as set forth in claim 1, in which said ram guiding means are substantially centered with respect to said end side portions.

* * * * *